United States Patent [19]

Bayer

[11] 4,170,413

[45] Oct. 9, 1979

[54] DEVICE FOR STABILIZING AND INCREASING CONTRAST POTENTIAL IN AN ELECTROPHOTOGRAPHIC COPIER

[75] Inventor: Eberhard Bayer, Munich, Fed. Rep. of Germany

[73] Assignee: Siemens Aktiengesellschaft, Berlin & Munich, Fed. Rep. of Germany

[21] Appl. No.: 913,700

[22] Filed: Jun. 8, 1978

[30] Foreign Application Priority Data

Jun. 14, 1977 [DE] Fed. Rep. of Germany ..... 2726805

[51] Int. Cl.[2] ..... G03G 15/00

[52] U.S. Cl. ..... 355/3 R; 96/1 R; 355/67

[58] Field of Search ..... 355/3 R, 67, 70, 71; 362/3; 96/1 R

[56] References Cited

U.S. PATENT DOCUMENTS

| | | | |
|---|---|---|---|
| 3,481,669 | 12/1969 | Roth et al. | 355/3 CH |
| 3,511,649 | 5/1970 | Felty et al. | 96/1 R |
| 3,615,395 | 10/1971 | Yamaji et al. | 96/1 R X |
| 3,666,364 | 5/1972 | Marushima | 96/1 R X |
| 3,930,853 | 1/1976 | Ciuffini | 96/1 R |
| 3,963,488 | 6/1976 | Brushenko | 96/1 R |

FOREIGN PATENT DOCUMENTS 1324851 7/1973 United Kingdom .

OTHER PUBLICATIONS

*Electrophotography,* R. M. Schaffert, 1975, pp. 67, 68 and 167.

*Primary Examiner*—R. L. Moses

*Attorney, Agent, or Firm*—Hill, Van Santen, Steadman, Chiara & Simpson

[57] ABSTRACT

A device is disclosed which is useful in an electrophotographic copier for stabilizing and increasing contrast potential. The device is employed for extinguishing a recorded, electrostatic charge image. The device has one or more light sources which provide a spectral distribution comprising a first spectral range of maximum photoconductivity production and a radiation energy which is three to ten times a radiation energy present in a second spectral range. The second spectral range is located at a wavelength determined by a maximum of a product of photoconductivity production and penetration depth. An additional radiation energy distribution in remaining portions of the spectral distribution has a radiation energy not exceeding five to ten percent of the radiation energy of the first range.

6 Claims, 3 Drawing Figures

Figure 1:
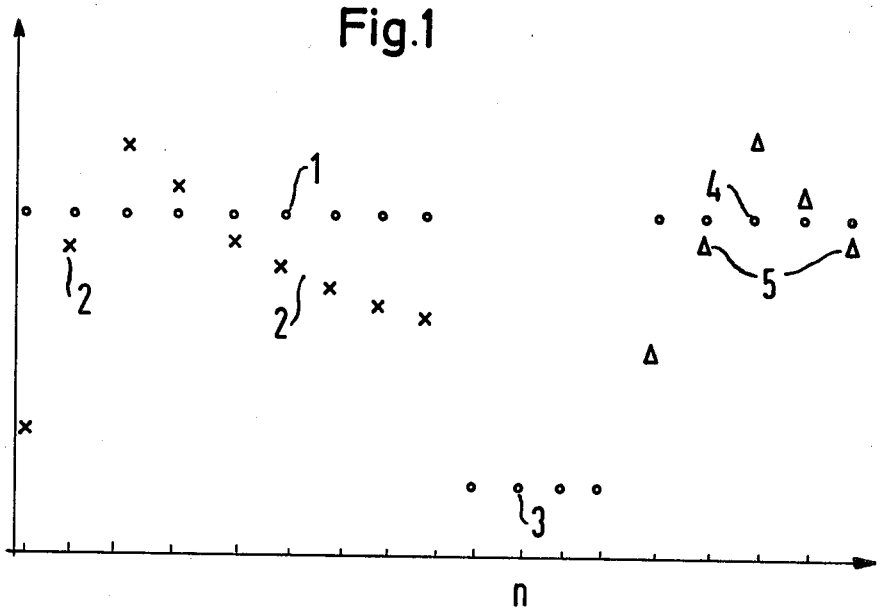

DEVICE FOR STABILIZING AND INCREASING CONTRAST POTENTIAL IN AN ELECTROPHOTOGRAPHIC COPIER

BACKGROUND OF THE INVENTION

The invention relates to a device in an electrophotographic copier having a light source with a given spectral distribution for extinguishing a recorded electrostatic charge image.

Electrophotographic copiers are known wherein an electrostatic charge image is produced in a layer consisting of a photoconductive material such as arsenic-selenium. In these copiers, the layer is charged with the aid of a corona discharge. The erasure of a recorded charge image is normally carried out with the light of a spectral range producing maximum photoconductivity. In the case of arsenic-selenium ($As_2Se_3$), which has been given by way of example, this spectral range lies in the green light zone at approximately 500 nm. The recording of the charge image is generally carried out using light from the same spectral range. However, proposals have also already been made such as for example in the earlier patent application U.S. Ser. No. 821,133 filed Aug. 21, 1977 of which I am co-inventor, for recording using light from the red spectral range. These proposals enable the recording of an electrostatic charge image which is not eliminated, but regenerated by the conventional corona charge. The erasure of a charge image recorded in this way is carried out in the conventional manner using green light as given above. Details of these proposals may be gathered from the above noted application which is incorporated herein by reference.

It has been proven that in electrophotographic copies of the described type, in the case of at least a number of photoconductive materials such as used for the aforementioned layer, fatigue effects occur. These fatigue effects occur in particular in the case of photoconductors having a mobility distribution which is dependent upon field strength, including the aforementioned $As_2Se_3$. A fatigue effect of this kind is described for example in German Offenlegungsschrift No. P 20 37 456.

The fatigue effect described in the aforementioned Offenlegungsschrift may be eliminated, as described therein, by carrying out a modified illumination of the photoconductive layer, the modification being dependent upon the actually existing surface potential of the photoconductor.

The fatigue phenomenon becomes manifest due to the fact that in the case of multiple, successive, cyclic charging of the photoconductive layer by corona discharge, a continuous decrease in the surface potential actually achieved occurs. This leads to contrast changes in the copies when the copier is used continuously.

The device described in the German Offenlegungsschrift No. P 20 37 456 at the least presents difficulties in maintaining the charging potential, and consequently for maintaining the constrast potential for recording light from copy to copy.

SUMMARY OF THE INVENTION

An object of the present invention is to provide measures for a copier of the type in question which solves the above noted problem.

This object is realized with a device having a light source means with a spectral distribution such that the spectral distribution comprises a first spectral range of maximum photoconductivity production centered about a first wavelength and having a radiation energy which is three to ten times a radiation energy present in a second spectral range determined by a maximum of a product of photoconductivity production and penetration depth. The second spectral range is centered about a second wavelength and a width of the first and second spectral ranges is approximately ±10% of the respective first and second wavelengths. An additional radiation energy distribution in remaining portions of the spectral distribution has a radiation energy not exceeding five to ten percent of the radiation energy of the first range.

The inventor's observations indicate that the use of light of an incandescent lamp having a predominantly red component or filtered components of one single spectral range for extinguishing purposes led to the above mentioned disadvantageous effect of the surface potential decreasing from copy to copy. The technique in accordance with the invention of specially designing the energy components of various spectral ranges of the light provided for extinguishing purposes allows this effect to be entirely eliminated. The attached FIG. 1 schematically illustrates the result which can be achieved with the invention in the form of a diagram. In the diagram, the charging surface potential is represented as the number of consecutive charges with a spot sequence 1. By way of comparison, the situation in which extinguishing has been carried out with the light of an incandescent lamp as employed in the prior art with filtering has been provided in this diagram as a sequence 2, composed of crosses. Each spot and each cross corresponds to a potential measurement following the charging of a drum which is employed in the conventional manner in copiers of this kind and upon which is arranged the photoconductive layer consisting of As-Se. No recording exposure takes place during the rotations of the sequences 1 and 2. The stabilizing effect which is achieved with the technique in accordance with the invention can be clearly seen from the diagram and from the difference between the sequence 1 and sequence 2.

The invention also serves to achieve a further advantage, namely, an increased contrast potential which is independent of the preceding exposure cycles. The circles of a sequence 3 indicate the potential of the photoconductive layer which is formed for one of the rotations of the drum, i.e for one of the successive copying processes which, when recording exposure is carried out with a light which, in accordance with the known prior art—see e.g. U.S. Pat. No. 3,511,649—leads to strong potential fatigue phenomena. The illustration has been standardized to these potential values 3 with respect to the ordinate.

It can be clearly seen from the above how, by employing the technique in accordance with the invention, a definite increase is achieved in the potential difference which can be analyzed as contrast and which is formed from the size of the sequence of spots 1, crosses 2 and circles 3. However, the above described advantage is also associated with the further advantage that following a recording exposure indicated by the sequence 3 of circles, during subsequent cycles of a sequence 4 (again shown in spots) in which no recording exposure is provided, the same potential value is set up as in the case of the sequence 1 and is in fact maintained for the further cycles. The spot sequences 1 and 4 thus together represent a charging of the surface potential which is constant independently of recording exposure processes, and which is achieved by means of the techniques in accordance with the invention for all cycles in which no recording exposure takes place (irrespectively of the number of preceding cycles of this type).

The diagram in FIG. 1 also shows those potential values of the surface potential which, on the other hand, are established when, for example, a filtered incandescent lamp is being used in accordance with the known prior art. The sequence 5, which is characterized by triangles, indicates the sequence of charges of the layer, occurring from cycle to cycle, counted after the last recording exposure to have been carried out, and in fact in the event that the techniques in accordance with the invention are not employed.

Summarized briefly, the invention provides that the light used for extinguishing purposes be composed of two spectral ranges. The one spectral range extends by approximately ±10% about a radiation wavelength at which a maximum achievement of photoconductivity can be attained in the photoconductive material. For $As_2Se_3$, this value of the maximum 12 is 500 nm. The width, provided at ±10%, characterizes the spectral range in which light is equal in value with respect to the photoconductivity production in the relevant material. The integral of the radiation energy over this range is active in the photoconductive material to produce photoconductivity. This similarly applies to another spectral range in which lies the wavelength for light of maximum product of photoconductivity production and penetration depth. The effect of the light 13 for the wavelength at which the product of photoconductivity production and penetration depth is the maximum, corresponds physically to an amplification effect produced by modified space charge conditions which produce a higher photoconductivity for light of all wavelength ranges which are shorter than the light of this spectral range 13.

In this context it should be mentioned that, apart from the light of these two indicated spectral ranges, further light 16 can only be irradiated with an overall energy which does not exceed 5 to 10% of the overall radiation energy of the first mentioned spectral range (maximum photoconductivity production) 11. The light, provided by the invention, for the two spectral ranges can thus consist of light of one single radiation source which, for example, is provided with corresponding filters. This design in accordance with the invention can also be achieved, however, with the aid of two light sources of which one emits a white light and the other emits light virtually only of the spectral range of the maximum photoconductivity production 11—in the case of the $As_2Se_3$—green light. Thus the light for the range of the maximum product can form part of this white light.

Figure 2:
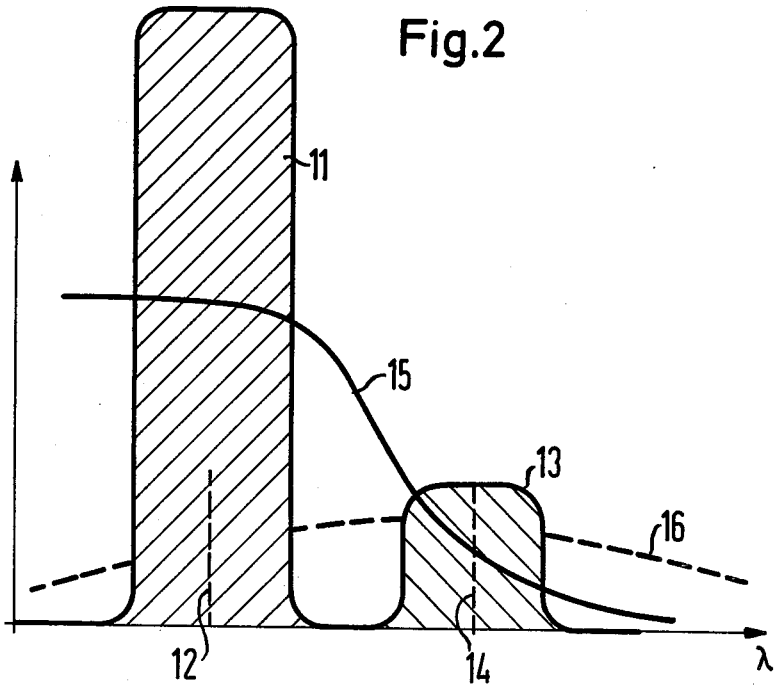

FIG. 2 indicates the spectral ranges and radiation energies of these ranges in relation to one another and with respect to the absorption curve of the material of the photoconductor. 11 designates the spectral range of maximum photoconductivity production, the wavelength of the maximum plotted on the abscissa being marked 12. The range 11 around this wavelength value 12 is defined at ±10%. It should be mentioned that the ±10% range is approximate and is dependent upon the relevant photoconductive material and fundamentally serves merely as an indication to the technician. The range of the wavelength of the maximum of the product of photoconductivity production and penetration depth is correspondingly referenced 13. This lies about a wavelength 14. The illustration in FIG. 2 shows an example of the energy ratio of the radiations of these ranges to one another. The approximate position of the absorption curve of a photoconductive material is plotted as 15 in the diagram of FIG. 2 in dependence upon the wavelength. This shows the position of the ranges provided in accordance with the invention relative to the absorption curve.

The line 16 in FIG. 2 indicates additional radiation which for example can be additionally present and which lies outside of the aforementioned spectral ranges. Spectral components of this radiation which fall into the relevant spectral ranges 11 and 13 should be included into the energy values of the ranges 11 and 13.

Figure 3:
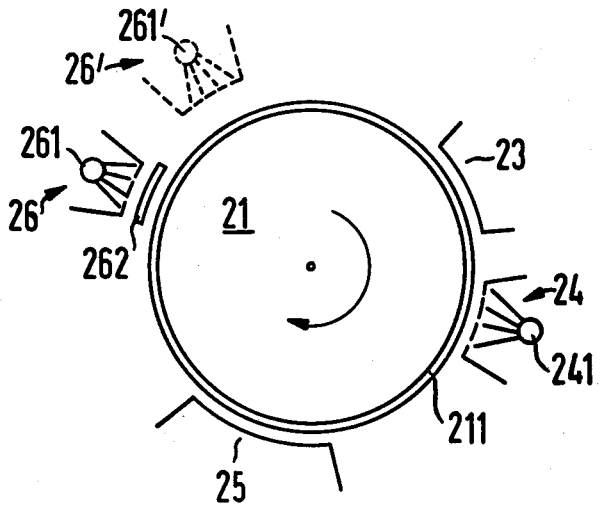

FIG. 3 schematically illustrates a copier, known per se, in which the invention is provided. 21 indicates a drum upon which the photo-sensitive layer 211 is arranged. A device for corona discharge is referenced 23. 24 indicates a device for recording exposure and which contains a light source 241, for example red light. A printer for the production of electrostatic copies is referenced 25. 26 indicates a device in which the invention is provided. The light source 261 arranged in this device 26 cam, for example, employ a filter 262 which supplies both the ight of the spectral range of maximum photoconductivity production and also the light of the spectral range of the maximum of the given product.

FIG. 9 contains a special embodiment of the invention in which, in addition to a first device 26 comprising a light source 261 for only the one spectral range, there is also provided a second device 26' having a light source 261' which produces the requisite light of the other spectral range. In fact it is not absolutely necessary to the invention that the light from the two spectral ranges should simultaneously hit the surface of the drum 21 and reach the layer 211. In fact it is also possible to carry out the irradiation of the light of the one spectral range following the irradiation of the light of the other spectral range (and vice versa). It is unnecessary to specifically point out that these two exposures are carried out consecutively (not e.g. by a corona charge or a copying process separately from one another), and in fact between the printing process using the device 25 and the (re-) charging of the corona device 23.

In the following a few numerical examples of the invention will be described which indicate the influence of the light energy components I(11) and I(13) upon the stabilization of the contrast potential when $As_2Se_3$ is used as photoconductor:

A $I(11)=50\times10^{-3}(W_s/m^2)$;
$\lambda(12)=500$ nm and
$I(13)=0$ results, in the case of a corona current density of $4.6\times10^{-4}(A/m^2)$, in a charging potential of 700 V. Then the contrast potential 5 minus 3 (FIG. 1) changes by 30% until a stabilized final value is established.

B $I(11)=I(13)=1.5\times10^{-3}(W_s/m^2)$;
$\lambda(12)=500$ nm;
$\lambda(14)=700$ nm results, with a corona current density of $13.4\times10^{-4}(A/m^2)$ in a charging potential of 550 V.

Then the contrast potential 5 minus 3 (FIG. 1) changes by 50% until a stabilized final value is established.

C $I(11)=10\times10^{-3}(W_s/m^2)$;
$\lambda(12)=500$ nm;
$I(13)=1.5\times10^{-3}W_s/m^2)$;
$\lambda(14)=700$ nm leads, with a corona current density of $13.4\times10^{-4}(A/m^2)$, to a charging potential of 700 V. Then the contrast potential 4 minus 3 (FIG. 1) changes by less than 3% until a stabilized final value is set, which indicates the desired influence of the proposed device 26.

As a result of the extinguishing exposure carried out in accordance with the invention, which can also be referred to as a preliminary exposure preceding the corona charging, an increased photosensitivity of the material of the layer is achieved for the recording exposure with a light having a long wave spectral range. Here "long wave" is to be understood as a wavelength range in which the light energy fundamentally corresponds to the band edge of the relevant photoconductive material. Here additional reference is made to U.S. Ser. No. 821,133. In the case of $As_2Se_3$ this is a range from approximately 550 to 650 nm. Recording using a wavelength having a length of this kind was previously out of the question in accordance with the practice set forth in U.S. Pat. No. 3,511,649.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A device in an electrophotographic copier, said device comprising: extinguishing means for a recorded, electrostatic charge image; said extinguishing means including light source means having a spectral distribution; said spectral distribution comprising a first spectral range of maximum photoconductivity centered about a first wavelength and having a radiation energy which is 3 to 10 times a radiation energy present in a second spectral range determined by a maximum of a product of photoconductivity production and penetration depth and being centered about a second wavelength; a width of the first and second spectral ranges being approximately ±10% of the respective first and second wavelength; and an additional radiation energy distribution in remaining portions of the spectral distribution having a radiation energy not exceeding 5 to 10% of the radiation energy of the first range.

2. A device as claimed in claim 1, characterized in that the light source means comprises a light source providing radiation energy for the second spectral range, said light source also emitting radiation of said additional radiation energy distribution.

3. A device as claimed in claim 2, characterized in that the radiation from said light source is substantially white light.

4. A device as claimed in claim 1 in which said light source means comprises a single radiation source producing radiation energies of the first and second spectral ranges and an associated filter producing said radiation energies of said first and second ranges and a limit for the radiation energy in said additional radiation energy distribution.

5. A device as claimed in claim 1, characterized in that said light source means comprises a first radiation source producing the first spectral range and a second radiation source producing the second spectral range.

6. An extinguishing device in an electrophotographic copier having a recorded electrostat charge image in a photoconductive layer, comprising:

(a) extinguishing means for extinguishing the electrostatic charge image in the photoconductive layer;

(b) said extinguishing means comprising a light source means with a spectral distribution comprising:

(i) a first spectral range encompassing a first wavelength of maximum photoconductive layer photoconductivity production and having a first radiation energy;

(ii) a second spectral range encompassing a second wavelength corresponding to a maximum of a product of photoconductive layer photoconductivity production and photoconductive layer penetration depth, and having a second radiation energy which is 3 to 10 times smaller than the first radiation energy;

(iii) a width of the first and second spectral ranges respectively being approximately ±10% of the respective first and second wavelengths; and (iv) an additional radiation energy distribution in remaining portions of the spectral distribution having a radiation energy not exceeding 5 to 10% of the radiation energy of the first spectral range.

* * * * *